United States Patent [19]

Sakamoto

[11] Patent Number: 5,054,457

[45] Date of Patent: Oct. 8, 1991

[54] WATER ELIMINATING SYSTEM FOR FUEL INJECTION SYSTEM

[75] Inventor: Osamu Sakamoto, Hamamatsu, Japan

[73] Assignee: Sanshin Kogyo Kabushiki Kaisha, Hamamatsu, Japan

[21] Appl. No.: 532,202

[22] Filed: Jun. 1, 1990

[30] Foreign Application Priority Data

Jun. 19, 1989 [JP] Japan ..... 1-156175

[51] Int. Cl.[5] ..... F02M 39/00

[52] U.S. Cl. ..... 123/533; 123/531; 123/542

[58] Field of Search ..... 123/540, 542, 531, 533, 123/563, 560, 65 B, 532, 534, 41.31; 165/71; 417/243; 239/132.3

[56] References Cited

U.S. PATENT DOCUMENTS

| | | | |
|---|---|---|---|
| 2,703,560 | 3/1955 | Lieberherr | 123/563 |
| 2,766,744 | 10/1956 | Steiger | 123/563 |
| 2,935,978 | 5/1960 | Kelgard et al. | 123/563 |
| 3,483,854 | 12/1969 | Foran et al. | 123/563 |
| 3,863,612 | 1/1975 | Wiener | 123/563 |
| 4,465,050 | 8/1984 | Igashira et al. | 123/533 |
| 4,841,942 | 6/1989 | McKay | 123/531 |
| 4,860,699 | 8/1989 | Rocklein | 123/531 |
| 4,928,491 | 5/1990 | Lindsay et al. | 123/531 |
| 4,984,540 | 1/1991 | Morikawa | 123/533 |
| 4,986,247 | 1/1991 | Kushibe et al. | 123/533 |

*Primary Examiner*—Andrew M. Dolinar
*Assistant Examiner*—M. Macy
*Attorney, Agent, or Firm*—E. A. Beutler

[57] ABSTRACT

A two cycle crankcase compression internal combustion engine including an air/fuel injector unit for injecting fuel and air into the engine. Compressed air is delivered to the fuel/air injector unit from an air compressor and a heat exchanger is provided in this line for cooling the air. The cooling is sufficient to cause condensation of any water vapor in the air and the condensate is drained from the system after the engine is stopped through an electrically operated valve. This valve also serves to reduce the pressure of the air in the system when the engine is stopped so that fuel and air will not be discharged if the fuel/air injector unit is removed when the engine is shut down for servicing.

16 Claims, 2 Drawing Sheets

WATER ELIMINATING SYSTEM FOR FUEL INJECTION SYSTEM

BACKGROUND OF THE INVENTION

This invention relates to a water eliminating system for a fuel injection system and more particularly to an improved arrangement for a fuel air injector that will ensure against the inclusion of a large amount of water in the air injected and also to a system of this type wherein the air pressure in the system can be relieved when the engine is shut down.

One popular type of injection system for an internal combustion engine is an injector that injects both fuel and air under high pressure into the engine. Such systems normally employ, in addition to a high pressure fuel pump, an air compressor that draws atmospheric air and compresses it. As is well known, when atmospheric air is compressed there is a likelihood of condensation of water from the vapor in the air into the liquid which can then flow through the system. Of course, in many environments, the condensed water can give rise to problems resulting from corrosion or the like. In addition, when the pressurized air is delivered through the system the water drops will tend to emulsify in with lubricant of the compressor or other lubricant contained within the system and can clog up the air passages. These problems are particularly prevalent when the associated engine is operated in a water vehicle since there is a high likelihood of large water content in the ingested air.

It is, therefore, a principal object of this invention to provide an improved injection system employing an air compressor and wherein the likelihood of containing water in the compressed air is reduced.

It is a further object of this invention to provide an improved arrangement for separating water from the air compressed in a fuel/air injection system.

It is a further object of this invention to provide an arrangement wherein the efficiency of the air injection is improved.

Another problem that is existent with fuel injection systems that inject both fuel and air under pressure is that when the engine is shut down, either or both of the air and fuel pressure lines may tend to maintain their pressurized status. Therefore, if someone attempts to disassemble the system for servicing, such as removing the fuel injector, the high pressure can cause leakage of both fuel and air and attendant problems therewith.

It is, therefore, a still further object of this invention to provide an arrangement for relieving a fuel/air injection system from pressure when the engine is shut down.

SUMMARY OF THE INVENTION

A first feature of this invention is adapted to be embodied in a fuel/air injector system for an internal combustion engine for combustion therein comprising a fuel/air injector unit that communicates with the engine for delivering fuel and air thereto. A fuel source is provided and means deliver fuel from the fuel source to the injector unit. A compressor is provided for compressing air and means including cooling means are incorporated for delivering the air from the air compressor to the injection unit.

Another feature of the invention is adapted to be embodied in a fuel/air injection system for an internal combustion engine for combustion therein. This invention includes fuel/air injector unit that communicates with the engine for delivering fuel and air thereto and fuel and air sources and fuel and air pressurizing devices for pressurizing the fuel and air, respectively, for delivery to the injector unit. In accordance with this feature of the invention, means are provided for relieving the pressure in the system when the engine is shut down.

DETAILED DESCRIPTION OF THE PREFERRED EMBODIMENT OF THE INVENTION

Figure 1:
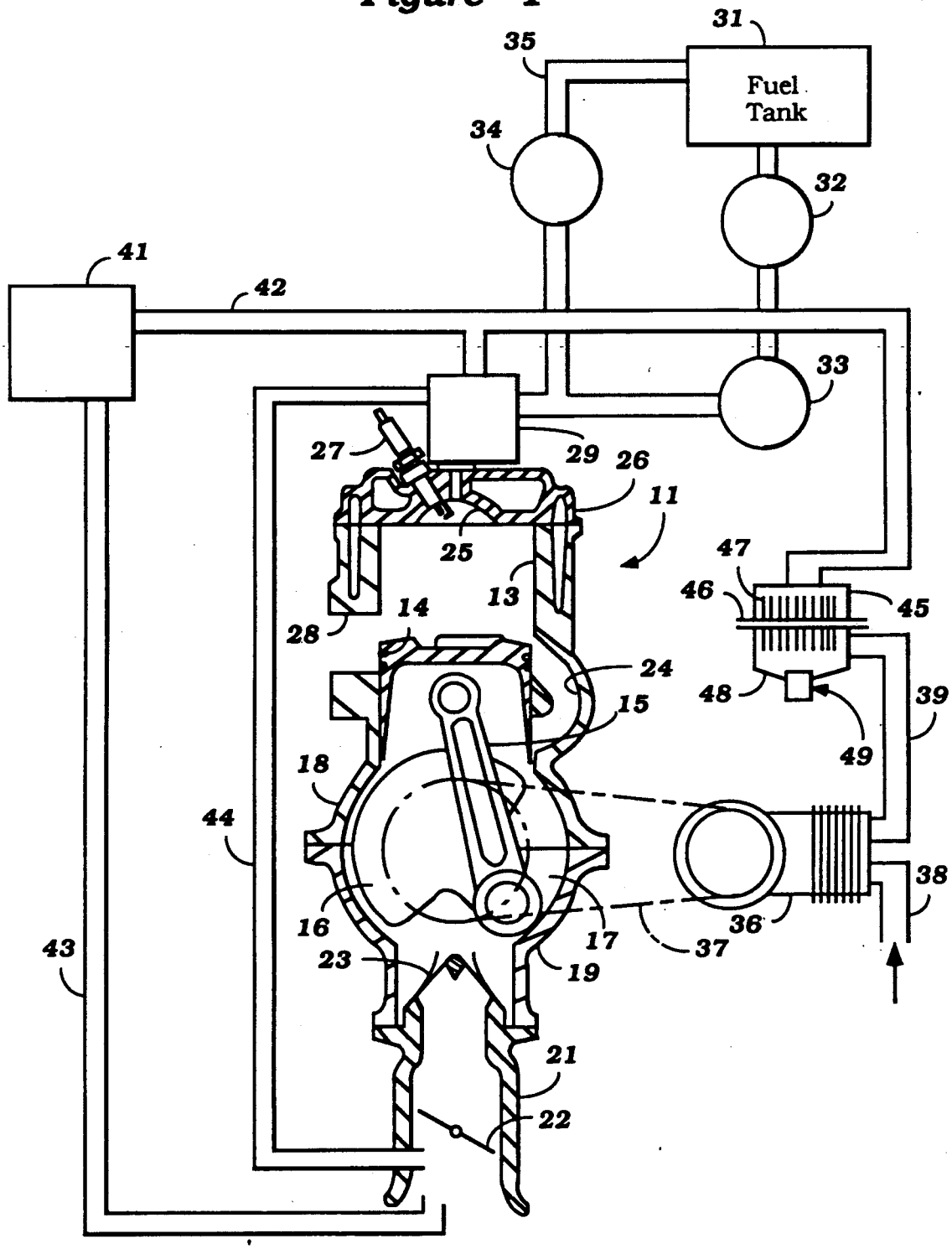
FIG. 1 is a cross sectional view taken through a single cylinder of an internal combustion engine constructed in accordance with an embodiment of the invention with certain auxiliary components shown schematically.

Referring first to FIG. 1, a single cylinder of a two cycle crankcase compression internal combustion engine is identified generally by the reference numeral 11 and is shown in cross section. The invention is described in conjunction with a single cylinder engine since the application of the invention to multiple cylinder engines will be readily apparent to those skilled in the art. Also, the invention is described in conjunction with a reciprocating two cycle crankcase compression engine because this type of engine is typical of those in which the invention may be embodied. It is to be understood, however, that the invention can be utilized in conjunction with other types of engines and other engines than those of the reciprocating type.

The engine 11 includes a cylinder block 12 in which a cylinder bore 13 is formed. A piston 14 reciprocates in a cylinder bore 13 and is connected by means of a connecting rod 15 to a crankshaft 16 for driving the crankshaft 16 in a known manner. The crankshaft 16 is journalled within a crankcase chamber 17 which is defined by a skirt 18 of the cylinder block 12 and a crankcase 19 that is affixed to this skirt in a known manner.

At least an air charge is delivered to the crankcase chamber 17 by an induction system that includes an intake manifold 21 in which a flow controlling throttle valve 22 is positioned. A reed type check valve 23 is disposed between the intake manifold 21 and the crankcase chamber 17 so as to permit air to enter the crankcase chamber 17 but which also prevents it from being discharged from the crankcase chamber 17 back through the manifold 21 when the piston 14 is on its down stroke.

When the piston 14 moves downwardly, the air charge admitted to the crankcase chamber 17 is compressed and delivered to the area above the piston 14 through one or more scavenge passages 24. This charge is then contained within a combustion chamber formed by a recess 25 in a cylinder head 26 that is affixed to the cylinder block 12. A fuel charge, is delivered to this combustion chamber 26 in a manner to be described and then is fired by a spark plug 27 in a known manner. The expanding charge will drive the piston 14 downwardly and at an appropriate interval and an exhaust port 28 will be opened and the burnt combustion products can exit. Since, as already noted, the construction of the engine 11 per se so forms no part of the invention further description of it is believed to be unnecessary.

A fuel/air charge is delivered to the combustion chamber 25 by a fuel/air injection unit, indicated generally by the reference numeral 29 and which is mounted in the cylinder head 26 in an appropriate manner. Fuel is supplied to the injector unit 29 from a remotely positioned fuel tank 31 through a filter 32 and by means of a high pressure pump 33. A pressure regulating valve 34 is positioned in a return conduit 35 and maintains the pressure of the fuel delivered to the injector unit 29 at the appropriate pressure by bypassing excess fuel back to the fuel tank 31. Compressed air is supplied to the injector unit 29 from a compressor 36 that is driven from the engine crankshaft 16 by means including a belt drive 37. The compressor 36 draws atmospheric air through an inlet 38 which may include an air intake device and silencer (not shown). The compressed air is then discharged through a conduit 39 to the injector unit 29.

In addition to supplying fuel and air to the engine 11 for its operation from the injector unit 29, both fuel and/or air may also be introduced either at all times or during certain running conditions to the intake manifold 21. For this purpose, there is provided an air pressure regulator 41 in an air delivery line 42 that communicates with the compressor outlet 39 in a manner to be described. The regulated air pressure is controlled by bypassing air through a conduit 43 back into the intake manifold 21 upstream of the throttle valve 22. In addition, when the injector 29 has discharged its fuel air charge the system may be returned to atmospheric pressure by venting to the intake manifold 21.

In a particular embodiment of the invention, the fuel pressure supplied to the injector 29 may be regulated by the valve 34 to a pressure in the range of 6.2 $kg/cm^2$ and the air pressure may be regulated by the regulator 41 to a pressure about 5.5 $kg/cm^2$. Of course, the invention can be utilized in conjunction with other pressures or other relative pressures and these are only examples of one embodiment of the invention.

In accordance with the invention, water is separated from the air compressed by the air compressor 36 by means of a heat exchanger 45. The heat exchanger 45 is in the illustrated embodiment of the air, water type and is provided with one or more conduits 46 on which fins 47 are provided and which pass the interior of the heat exchanger 45. Engine coolant may be circulated in a known manner through the tubes 46 and will serve to cool the air that is compressed by the compressor 36. Sufficient cooling is accomplished so as to cause any significant amount of water vapors to condense and collect in a drain 48 at the bottom of the heat exchanger 45. A valve 49 having a construction as best shown in FIG. 2 is provided for sequentially draining this condensed water vapor from the heat exchanger 45.

Because of the use of the heat exchanger 45 it will be ensured that there is little water present in the air directed to the injection unit 29 and the aforenoted problem will be specifically avoided. In addition, due to the cooling of the air by the heat exchanger 45 the efficiency of air injection will also be improved.

Figure 2:
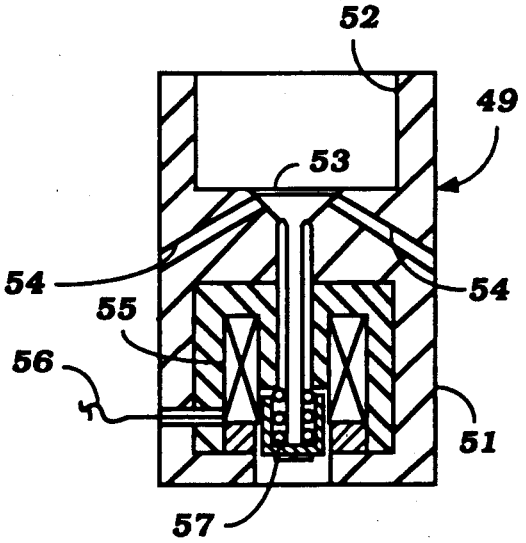
FIG. 2 is an enlarged cross sectional view of the fuel and decompression valve of the embodiment shown in FIG. 1.

Referring now in detail to FIG. 2, the valve 49 is comprised of a main body portion 51 that defines a well 52 that communicates with the interior of the heat exchanger 45 as aforedescribed. A poppet type valve 53 controls the communication of the well 52 with a plurality of drain ports 54 that extend at an angle through the housing 51. The valve 53 has its stem encircled by winding 55 of an electromagnet that has leads 56 that are connected to an appropriate power source, in a manner to be described. A coil compression spring 57 acts against the valve stem 53 and normally urges it to the closed position as shown in FIG. 2.

In operation, the valve 53 is held in its closed position as shown in FIG. 2 during periods of time when the engine 11 is running. As a result, there will be no loss in air pressure and condensed water will accumulate in the heat exchanger well 46 and the valve well 52. At such time as the engine is shut off, the solenoid winding 55 is energized and the valve element 53 will be urged upwardly to open the drain ports 54. This can be wired into the system so that when a kill switch is turned on or an ignition switch is turned off, the valve element 53 will be opened, preferably after some slight time delay. Condensed water will then drain through the ports 54 and be discharged. At the same time, any residual air pressure in the system will also be relieved and this will facilitate servicing of the injector unit 29. That is, the injector unit 29 can be removed when the engine is shut down without the risk of fuel being discharged due to the high pressure which would otherwise remain in the line 42.

In addition to having the aforenoted advantages, the fact that cool air is delivered to the injector unit 29 will ensure that its electrical components will not be overheated. That is, both the air and/or fuel supply control solenoids which may be present in this unit 29 will be cooled.

It should be readily apparent from the foregoing description that the illustrated embodiment of the invention is very effective in providing a high efficiency air/fuel injection unit and one which will be free of water condensation and furthermore which will operate with high efficiency. In addition, residual air pressure in the system will be relieved prior to servicing and avoid any problems in this area. Although an embodiment of the invention has been illustrated and described, various changes and modifications may be made without departing from the spirit and scope of the invention, as defined by the appended claims.

I claim:

1. A fuel/air injector system for an internal combustion engine comprising a fuel/air injector unit communicating with said engine for delivering fuel and air thereto, a fuel source, means for delivering fuel from said fuel source to said injector unit, an air compressor for compressing air, and including means for cooling the compressed air in the means for delivering air from said air compressor to said injector unit.

2. A fuel/air injector system for an internal combustion engine as set forth in claim 1 wherein the cooling means provides adequate cooling for condensing any water vapor contained within the air compressed by the air compressor.

3. A fuel/air injector system for an internal combustion engine as set forth in claim 2 further including valve drain means for draining condensed water vapor from the cooling means.

4. A fuel/air injector system for an internal combustion engine as set forth in claim 3 wherein the valve drain means is operated after the engine is shut off for draining the condensed water vapor without causing a reduction in air pressure during engine running conditions.

5. A fuel/air injector system for an internal combustion engine as set forth in claim 4 wherein the valve drain means further relieves the air pressure, in the system when the engine has been shut off and the valve drain means is opened.

6. A fuel/air injector system for an internal combustion engine as set forth in claim 2 wherein the condenser is cooled by liquid coolant of the engine.

7. A fuel/air injector system for an internal combustion engine as set forth in claim 6 wherein the engine coolant is circulated through the cooling means.

8. A fuel/air injector system for an internal combustion engine as set forth in claim 7 further including valve drain means for draining condensed water vapor from the cooling means.

9. A fuel/air injector system for an internal combustion engine as set forth in claim 8 wherein the valve drain means is operated after the engine shut off for draining the condensed water vapor without causing a reduction in air pressure during engine running conditions.

10. A fuel/air injector system for an internal combustion engine as set forth in claim 9 wherein the valve drain means further relieves the air pressure in the system when the engine has been shut off and the valve drain means is opened.

11. A fuel/air injector system for an internal combustion engine comprising a fuel/air injector unit communicating with said engine for delivering fuel and air thereto, a fuel source, means for delivering fuel from said fuel source to said injection unit, an air compressor for compressing air, means for delivering compressed air from said air compressor to said fuel/air injector unit, and means for relieving the air pressure in said system when the engine is not running.

12. A fuel/air injector system for an internal combustion as set forth in claim 11 wherein the air pressure is relieved upon the stopping of the engine.

13. An internal combustion engine comprising an air compressor for delivering compressed air to said engine, means for cooling the air delivered from said air compressor to said engine, said cooling means providing adequate cooling for condensing any water vapor contained within the air compressed by said air compressor, and valve drain means for draining condensed water vapor from said cooling means.

14. An internal combustion engine as set forth in claim 13 wherein the valve drain means is operated after the engine is shut off for draining the condensed water vapor without causing a reduction in air pressure during engine running conditions.

15. A fuel/air injector system for an internal combustion engine as set forth in claim 13 wherein the valve drain means further relieves the air pressure in the system when the engine has been shut off and the valve means is opened.

16. A fuel/air injector system for an internal combustion engine as set forth in claim 15 wherein the condenser is cooled by liquid coolant of the engine.

* * * * *